United States Patent [19]

Zinnbauer

[11] Patent Number: 4,722,462

[45] Date of Patent: Feb. 2, 1988

[54] COLLAPSIBLE SOLID DEODORANT DISPENSING PACKAGE

[75] Inventor: Gerald B. Zinnbauer, Bay Village, Ohio

[73] Assignee: Owens-Illinois Closure Inc., Toledo, Ohio

[21] Appl. No.: 910,060

[22] Filed: Sep. 22, 1986

[51] Int. Cl.[4] ..... B67D 5/06

[52] U.S. Cl. ..... 222/183; 220/306; 206/823; 229/DIG. 3

[58] Field of Search ..... 222/187, 183, 182, 179.5, 222/173; 206/77.1, 804, 823, 822; 229/DIG. 3, 1.5 R; 220/306, 307

[56] References Cited

U.S. PATENT DOCUMENTS

| | | | |
|---|---|---|---|
| 3,282,477 | 1/1961 | Henchert | 220/306 |
| 4,303,176 | 12/1981 | Swartzbaugh | 220/306 |
| 4,313,558 | 2/1982 | Benham | 229/DIG. 3 |
| 4,549,669 | 10/1985 | Rozporka | 220/306 |

FOREIGN PATENT DOCUMENTS

| | | | |
|---|---|---|---|
| 60852 | 3/1968 | Fed. Rep. of Germany | 229/DIG. 3 |

*Primary Examiner*—Joseph J. Rolla
*Assistant Examiner*—Kenneth Noland
*Attorney, Agent, or Firm*—H. G. Bruss

[57] ABSTRACT

A solid deodorant dispensing package that includes a container with a dispensing opening, a solid deodorant with a portion that extends through the dispensing opening of the container upon the squeezing of the container, and a closure that is formed integrally with the container for selectively opening and closing the dispensing opening. The container is generally wedge-shaped with first and second major sides diverging away from one another as they extend from a juncture therebetween to the dispensing opening and with pleated ends which extend between the first and second major sides which, because of their pleated configuration, permit the included angle between the first and second major sides to be reduced by squeezing the first and second major sides, an action which advances the solid deodorant through the dispensing opening. The closure is hingedly connected to one of the major sides of the container and has a projection which is received in a recess in the other of the major sides to form a snap fit therebetween.

7 Claims, 6 Drawing Figures

COLLAPSIBLE SOLID DEODORANT DISPENSING PACKAGE

BACKGROUND OF THE INVENTION

1. Field of the Invention

This invention relates to a dispensing package for a solid deodorant. More particularly, this invention relates to a dispensing package for a solid deodorant in which the solid deodorant is gradually dispensed from a container component of the package by squeezing the container to effect the dispensing of the solid deodorant by the collapsing of the container that results from its squeezing. The package is closed when not in use by a closure that is either formed integrally with the container or as a separate element.

2. Description of the Prior Art

Solid deodorants are now packaged in dispensing packages mainly in either an oval shape or a cylindrical or rodlike shape. In either such package type, the solid deodorant is elevated to a proper dispensing position, relative to a container element of the package, usually by a separate screw-type mechanism or occasionally by separate parts which slide relative to one another. In the case of a dispensing package that utilizes a screw-type or other elevating mechanism, the need for the elevating mechanism increases the complexity of the package, and thereby decreases the reliability of its operation and increases the cost of its materials and assembly, and can lead to confusion in the use of the dispensing package by consumers who are not familiar with the operation of the elevating mechanism. Additionally, the filling of the container with the solid deodorant to be packaged therein is complicated by the design of the container or associated solid deodorant elevating mechanism, often precluding the use of desirable hot-fill filling techniques or the use of solid deodorant compositions solely due to viscosity characteristics that are undesirable for filling.

SUMMARY OF THE PRESENT INVENTION

According to the present invention there is provided a solid deodorant dispensing package in which the solid deodorant is contained in, and corresponds in shape to, the inside of a container whose external configuration is generally that of a wedge or, more precisely, a container whose external configuration is generally pyramidal or frusto-pyramidal. The solid deodorant is dispensed through an open base portion of the container by squeezing the outwardly diverging sides of the container to present the top surface of the solid deodorant, which gradually recedes in use, at a suitable position for use. The outwardly diverging sides of the container are connected to one another at the opposed ends of the container by transversely extending end panels, each of such transversely extending end panels having a multiplicity of outwardly diverging pleats therein to provide a bellows-type appearance that facilitates the collapsing of the container upon the squeezing of the sides.

In use, the top surface of the solid deodorant extends beyond the open base of the container, for proper access to the solid deodorant by the user. When the solid deodorant is not in use, the exposed portion that includes such top surface is enclosed by a cup-shaped closure that is secured to the container at the open base thereof by a snap fit or in any other suitable manner, the closure preferably being formed integrally with the container and being foldably joined to the container by a hinge along the edge of one of the sides of the container at the open base thereof. In this manner, the container and the closure cannot normally be disassociated during use, a factor which helps to ensure that the package can be properly reclosed after use. Alternatively, if desired, the container and closure can be formed as separate items.

Accordingly, it is an object of the present invention to provide a new and improved solid deodorant dispensing package. It is a further object of the present invention to provide a solid deodorant dispensing package in which the dispensing of the solid deodorant can be accomplished without the need for a separate screw-type or other elevating mechanism.

It is also an object of the present invention to provide a solid deodorant dispensing package which can accommodate a wide range of solid deodorant compositions and filling techniques.

It is yet another object of the present invention to provide a solid deodorant dispensing package that has an external shape which permits a group of such dispensing packages to be packaged in bulk for shipment without excessive wasted space in such bulk package.

It is yet another object of the present invention to provide a solid deodorant dispensing package in which the container and closure elements of such package can be satisfactorily mass-produced from relatively inexpensive thermoplastic materials by conventional molding processes and equipment.

It is also an object of the present invention to provide a solid deodorant dispensing package which, when displayed in the usual manner, presents an inclined, readily decorable flat surface that is of enhanced visibility to a purchaser or prospective purchaser.

For a further understanding of the present invention and the objects thereof, attention is directed to the drawing and the brief description thereof, to the detailed description of the preferred embodiment and to the appended claims.

DETAILED DESCRIPTION OF THE PREFERRED EMBODIMENT

Figure 1:
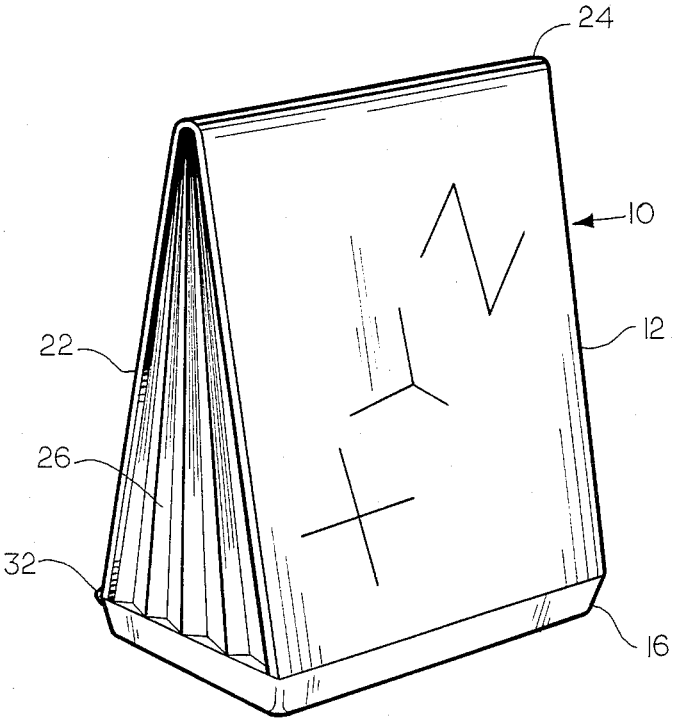
FIG. 1 is a perspective view of the preferred embodiment of a closed solid deodorant dispensing package in the normal orientation of the package when it is on display on a shelf in a retail store or when it is otherwise at rest.
Figure 2:
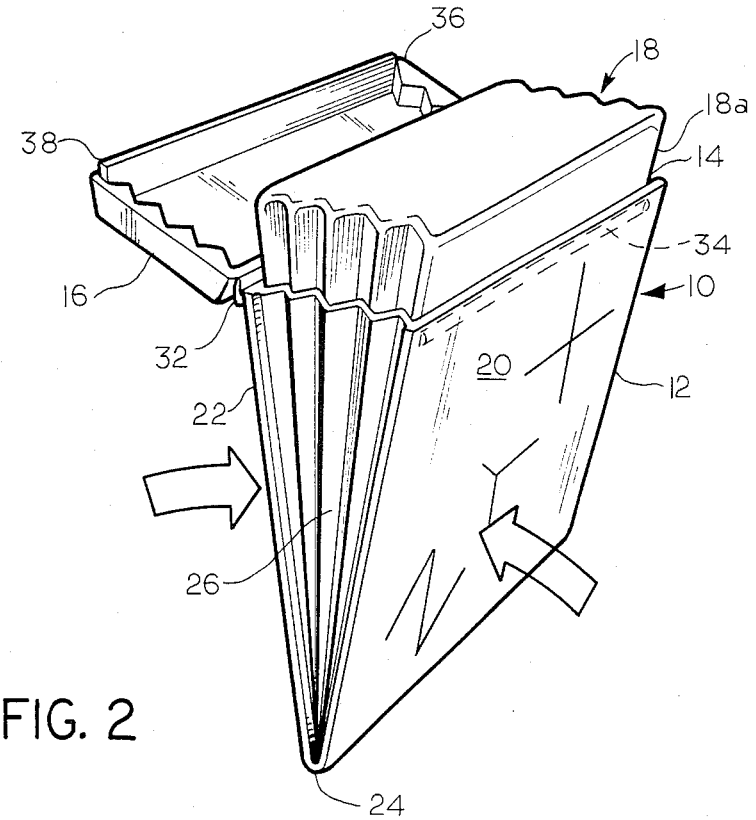
FIG. 2 is a perspective view of the solid deodorant dispensing package of FIG. 1 in the normal orientation of the opened package during use.
Figure 4:
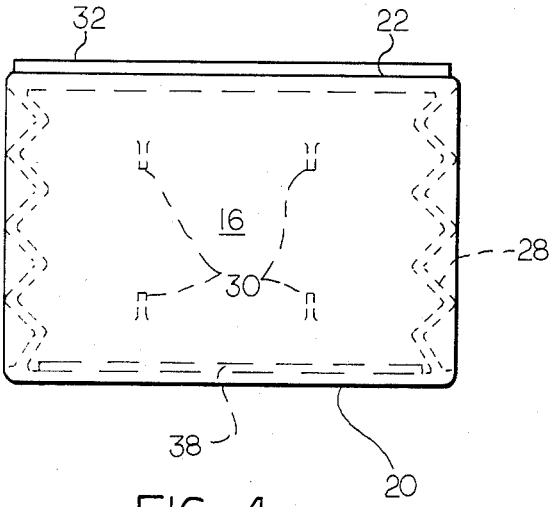
FIG. 4 is a top plan view of the solid deodorant dispensing package as shown in FIG. 3.

A solid deodorant dispensing package is shown in FIG. 1 in its normal storage or non-dispensing position and is generally identified by reference numeral 10. The solid deodorant dispensing package 10 is also shown in FIG. 2 in its normal dispensing position in which it is inverted from the position shown in FIG. 1. As is shown in FIG. 2, the solid deodorant dispensing package 10 includes a container 12 which is hollow on the inside and which, in its external configuration, is generally shaped like a wedge or pyramid and which has an opening 14 at its base, and the solid deodorant dispensing package further includes a generally cup-shaped closure 16, for selectively closing and opening the opening 14 of the container 12, and a solid deodorant 18. The solid deodorant 18 fills and confonms to the interior of the container 12 and has a portion 18*a* that extends beyond the opening 14 in the container 12 for ready access by a user when the closure 16 is in its opened position, as shown in FIG. 2.

The container 12 has first and second major sides 20 and 22, respectively, which converge toward one another as they extend away from the opening 14 toward a bight 24 at the juncture of the first and second major sides 20 and 22. The container 12 further has first and second ends 26 and 28, respectively, which extend between the opposed ends of the first and second major sides 20 and 22. The first and second ends 26 and 28, as shown, are pleated or corrugated in configuration, and by virtue of this configuration, they collapse when opposed compressive forces are imposed against the first and second major sides 20 and 22, for example, by hand gripping. It is also contemplated that the collapsibility of the first and second ends 26 and 28 can be achieved by making them thinner or otherwise weaker than the first and second major sides 20 and 22. Such an application of compressive forces against the first and second major sides 20 and 22 will, therefore, tend to reduce the included angle between the first and second major sides 20 and 22 and will thereby tend to elevate the portion 18*a* of the solid deodorant 18 with respect to the opening 14 for access by a user. However, the first and second ends have sufficient resiliency so that they will tend to return to their original configuration upon the removal of the opposed compressive forces against the first and second major sides 20 and 22, thus, reestablishing the original included angle between the first and second major sides 20 and 22 and allowing the solid deodorant 18 to retract within the container 12 by gravity, when the container 12 is in the orientation shown in FIG. 3.

To help to prevent the escape of the deodorant 18 from within the container 12 upon the accidental or inadvertent inversion of the container 12, the inside surface of each of the first and second major sides 20 and 22 is provided with one or more retainers 30, shown as two of such retainers 30 on each of the first and second major sides 20 and 22, which extend into the solid deodorant 18. Thus, for the solid deodorant 18 to advance beyond the opening 14 of the container 12, it is necessary for a groove or furrow to be formed by each such retainer 30 in the solid deodorant 18, and any subsequent advance of the solid deodorant 18 that is beyond the prior point of maximum advance requires a corresponding extension of each such groove or furrow.

The closure 16 is preferably formed integrally with the container 12 and, in such construction, it is hingedly connected to the top side of one of the first and second major sides 20 and 22, shown as the second major side 22, along hinge line 32. In the illustrated embodiment, the container 12 and the closure 16 may readily be formed from a suitable thermoplastic material by injection molding. Suitable thermoplastic materials include high density polyethylene and modifications thereof, polypropylene and modifications thereof and flexible forms of polystyrene such as butadienestyrene. Such materials are relatively inexpensive and have good rigidity and strength for the intended application, they can be molded by conventional molding practices with precise dimensions, they have good mechanical and chemical durability, and they can be molded with an aesthetically pleasing shape, coloration and texture, factors which are important in a product that is to be sold in large quantities to consumers. Additionally, such materials can be readily decorated by conventional printing techniques and materials.

Figure 3:
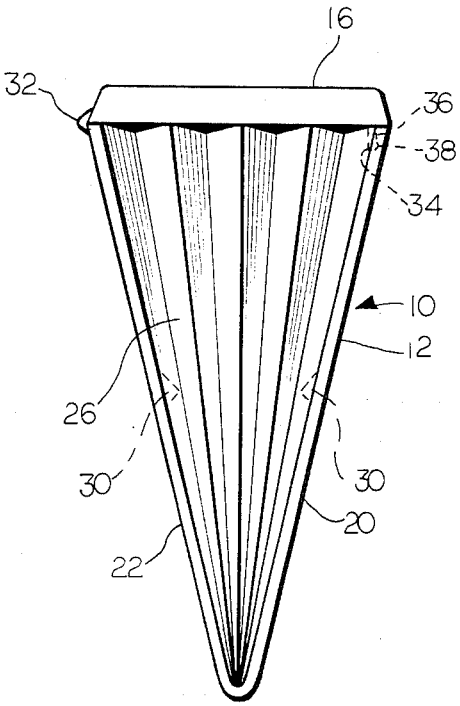
FIG. 3 is an end elevational view of the solid deodorant dispensing package of FIGS. 1 and 2 showing the package closed, but otherwise in the orientation shown in FIG. 2.

To help retain the closure 16 in its closing position with respect to the container 12, as is shown in FIGS. 1 and 3, a snap fit is provided by providing the inside of the first major side 20 with a laterally extending recess 34 and by providing the closure 16 with a downwardly depending tab 36 with an outwardly projecting and laterally extending enlarged portion 38 at the margin thereof, the enlarged portion 38 of the downwardly depending tab 36 engaging the laterally extending recess 34 of the first major side when the closure 16 is in its desired closing position on the container 12.

While the use of a container 12 with a closure 16 formed integrally therewith and connected by an integrally molded hinge or strap has been disclosed, the use of a separate container and a separate closure is also contemplated. In fact, the use of a separate container and closure would be advantageous in that it would permit the container and closure to be molded from differently colored thermoplastic materials, if that were desired for aesthetic reasons.

Figure 6:
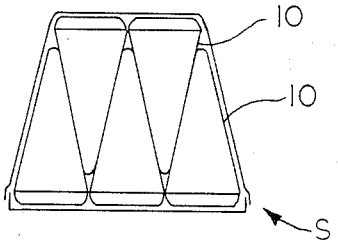
FIG. 6 is a schematic view, at a reduced scale, of a group of solid deodorant dispensing packages according to FIGS. 1 through 5 packaged together for bulk shipment.
Figure 5:
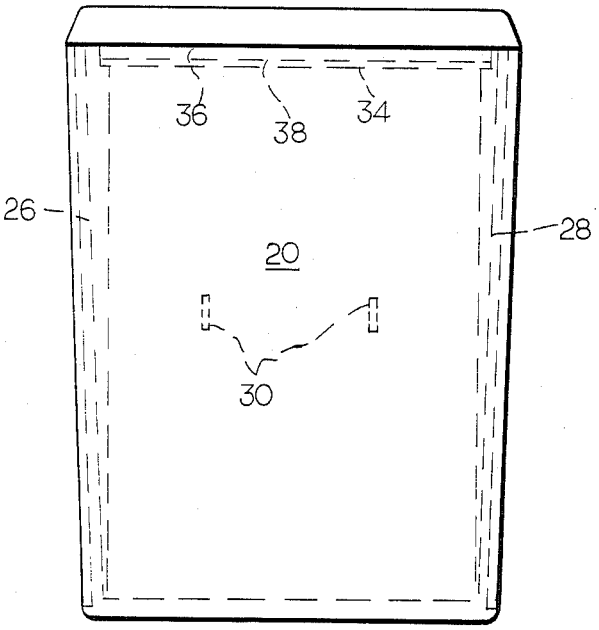
FIG. 5 is a front elevational view of the solid deodorant dispensing package as shown in FIGS. 3 and 4.

As is shown in FIG. 6, a group of solid deodorant dispensing packages 10 can be bulk packaged with little or no wasted space for ease and economy in shipment by placing every other solid deodorant dispensing package in its upright dispensing position in a shipping container S, with alternating solid deodorant dispensing packages 10 being inverted.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A solid deodorant dispensing package comprising:
a collapsible container, said container having:
first and second sides, said first and second sides converging outwardly from a juncture between said first and second sides and defining an included angle therebetween; and
first and second ends, said first and second ends being spaced apart from one another, each of said first and second ends being pleated in configuration and being joined to and extending between said first and second sides, said first and second sides and said first and second ends defining a dispensing opening that is away from said juncture, said container being collapsible by the application of opposed forces against the first and second sides to reduce said included angle therebetween, said first and second sides and said first and second end defining an interior of said container;

a solid deodorant contained within said collapsible container, said solid deodorant filling and conforming to said interior of said container and having a portion which is advanced beyond said dispensing opening by the collapsing of said collapsible opening; and closure means for selectively closing and opening said dispensing opening of said container.

2. A solid deodorant dispensing package according to claim 1 wherein said closure means and said container are formed integrally with one another from a thermoplastic material, said closure means being hingedly joined to one of said first and second sides of said container adjacent said opening.

3. A solid deodorant according to claim 2 wherein said thermoplastic material is selected from the group consisting of high density polyethylene, modifications of high density polyethylene, polypropylene, modifications of polypropylene, and flexible forms of polystyrene.

4. A solid deodorant dispensing package according to claim 2 wherein the other of said first and second sides of said container is provided with a laterally extending recess adjacent said opening and wherein said closure means is provided with a laterally extending projection that is received in said laterally extending recess when said closure means is closing said dispensing opening.

5. A solid deodorant dispensing package according to claim 4 wherein said closure means comprises a generally cup-shaped member.

6. A solid deodorant dispensing package comprising:

a collapsible container, said container having:

first and second sides, said first and second sides converging outwardly from a juncture between said first and second sides and defining an included angle therebetween; and first and second ends, said first and second ends being spaced apart from one another, each of said first and second ends being pleated in configuration and being joined to and extending between said first and second sides, said first and second sides and said first and second ends defining a dispensing opening that is away from said juncture, said container being collapsible by the application of opposed forces against the first and second sides to reduce said included angle therebetween;

a solid deodorant contained within said collapsible container, said solid deodorant having a portion which is advanced beyond dispensing opening upon the collapsing of said collapsible opening;

retainer means attached to one of said first and second sides and projecting into said solid deodorant within said container; and closure means for selectively closing and opening said dispensing opening of said container.

7. A solid deodorant dispensing package according to claim 6 wherein said container further has:

second retainer means attached to the other of said first and second sides and projecting into said solid deodorant to further help to retain said solid deodorant within said container.

* * * * *